US011326367B2

(12) United States Patent
Lunday et al.

(10) Patent No.: US 11,326,367 B2
(45) Date of Patent: May 10, 2022

(54) KNOB ASSEMBLY WITH FREE-SPINNING RING

(71) Applicant: Schlage Lock Company LLC, Carmel, IN (US)

(72) Inventors: Drake Lunday, Colorado Springs, CO (US); Paul J. Meisel, Peyton, CO (US); Nathanael Taylor, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 565 days.

(21) Appl. No.: 16/265,181

(22) Filed: Feb. 1, 2019

(65) Prior Publication Data

US 2020/0248475 A1 Aug. 6, 2020

(51) Int. Cl.

| | |
|---|---|
| ***E05B 13/00*** | (2006.01) |
| ***E05B 55/00*** | (2006.01) |
| ***E05B 1/00*** | (2006.01) |
| ***E05B 3/00*** | (2006.01) |
| ***E05B 13/10*** | (2006.01) |
| ***E05B 65/00*** | (2006.01) |

(52) U.S. Cl.

CPC ..... *E05B 13/00* (2013.01); *E05B 1/003* (2013.01); *E05B 1/0061* (2013.01); *E05B 55/005* (2013.01); *E05B 3/00* (2013.01); *E05B 13/001* (2013.01); *E05B 13/005* (2013.01); *E05B 13/10* (2013.01); *E05B 13/106* (2013.01); *E05B 65/0014* (2013.01); *E05Y 2900/132* (2013.01); *Y10T 292/03* (2015.04); *Y10T 292/57* (2015.04); *Y10T 292/82* (2015.04)

(58) Field of Classification Search

CPC ..... E05B 13/00; E05B 1/003; E05B 1/0061; E05B 55/005; E05B 3/00; E05B 13/106; E05B 55/06; E05B 2015/0448; E05B 17/00; E05B 65/0014; E05B 13/10; E05B 13/005; E05Y 2900/132; Y10T 292/1016; Y10T 292/82; Y10T 292/03; Y10T 16/6285; Y10T 74/20876; Y10T 16/46; Y10T 16/625; Y10S 70/58

See application file for complete search history.

(56) References Cited

U.S. PATENT DOCUMENTS 793,087 A * 6/1905 McVitty ..... E05B 13/103 70/214

2,587,285 A 2/1952 Broscoe (Continued)

*Primary Examiner* — Christine M Mills

*Assistant Examiner* — Faria F Ahmad

(74) *Attorney, Agent, or Firm* — Taft Stettinius & Hollister LLP

(57) ABSTRACT

An exemplary knob assembly includes a knob having a circumferential channel, and a deformable ring seated in the circumferential channel. The ring is normally rotatable relative to the knob such that rotation of the ring does not cause a corresponding rotation of the knob. When gripped with a sufficient gripping force, the ring frictionally engages and rotationally couples with the knob, thereby permitting transmission of torque between the ring and the knob. In certain embodiments, the knob assembly may include a detent mechanism operable to selectively couple the ring and the knob. In certain embodiments, the ring may include protrusions operable to engage pockets in the knob to provide for rotational coupling.

24 Claims, 4 Drawing Sheets

(56) References Cited

U.S. PATENT DOCUMENTS 2,610,877 A * 9/1952 Weaver ..... E05B 13/001 292/1
3,306,643 A * 2/1967 Reed ..... E05B 13/001 292/1
3,556,571 A 1/1971 Laub, Jr.
3,739,608 A * 6/1973 Young ..... E05B 13/001 70/209
4,007,956 A * 2/1977 Harris ..... E05B 13/001 292/347
4,069,692 A * 1/1978 Hemphill ..... B60R 25/007 244/224
4,082,351 A 4/1978 Chrones
4,570,470 A 2/1986 Gray, Sr.
4,648,643 A 3/1987 Bettger
4,869,305 A * 9/1989 Jones ..... E05B 13/001 150/155
5,074,604 A * 12/1991 Merendino ..... E05B 63/18 292/258
5,201,202 A * 4/1993 Kam ..... E05B 13/001 70/168
5,375,295 A 12/1994 Woodward
5,423,583 A 6/1995 Crockom
5,701,635 A * 12/1997 Hawkes ..... E05B 1/0061 16/421
6,179,352 B1 * 1/2001 Schneeberger ..... E05B 13/005 292/336.3
6,324,879 B1 * 12/2001 Kennedy ..... E05B 13/001 70/416
7,334,824 B2 * 2/2008 Sundberg ..... E05B 13/001 292/1
7,661,734 B2 2/2010 Lignell
8,100,443 B2 1/2012 Talpe
9,188,408 B2 * 11/2015 Huynh ..... F41G 1/22
9,834,956 B2 12/2017 Hogan
9,909,685 B1 3/2018 Flores et al.
10,294,697 B2 * 5/2019 Sundberg ..... E05B 37/20
2008/0197642 A1 * 8/2008 Talpe ..... E05B 13/005 292/336.3
2009/0282652 A1 11/2009 Maramba
2018/0051485 A1 2/2018 Moore

* cited by examiner

KNOB ASSEMBLY WITH FREE-SPINNING RING

TECHNICAL FIELD

The present disclosure generally relates to child-resistant knob assemblies, and more particularly but not exclusively relates to locksets including such knob assemblies.

BACKGROUND

It is occasionally desirable to discourage rotation of a knob by children, for example to prevent the child from opening a door, operating a faucet, or activating a burner on a stove. Certain conventional approaches to discouraging such rotation by children generally involve placing a shell on the knob such that the shell loosely encapsulates the knob and is rotatable relative to the knob. When a child attempts to rotate the knob, he or she instead grips and rotates the shell, which does not cause rotation of the knob or adjustment of the device that is controlled by the knob. The shell typically includes openings through which those with sufficient manual dexterity (e.g., adults) can grip the knob.

The above-described conventional approaches have certain drawbacks and limitations, such as those related to aesthetics, performance, and robustness. For example, the shell is typically aesthetically displeasing, and due to the loose mounting on the knob, can cause undesirable rattling. Additionally, the shell is typically formed of two pieces that snap together, and which can be separated from one another by children tampering with the shell. For these reasons among others, there remains a need for further improvements in this technological field.

SUMMARY

An exemplary knob assembly includes a knob having a circumferential channel, and a deformable ring seated in the circumferential channel. The ring is normally rotatable relative to the knob such that rotation of the ring does not cause a corresponding rotation of the knob. When gripped with a sufficient gripping force, the ring frictionally engages and rotationally couples with the knob, thereby permitting transmission of torque between the ring and the knob. In certain embodiments, the knob assembly may include a detent mechanism operable to selectively couple the ring and the knob. In certain embodiments, the ring may include protrusions operable to engage pockets in the knob to provide for rotational coupling. Further embodiments, forms, features, and aspects of the present application shall become apparent from the description and figures provided herewith.

DETAILED DESCRIPTION OF ILLUSTRATIVE EMBODIMENTS

Figure 1:
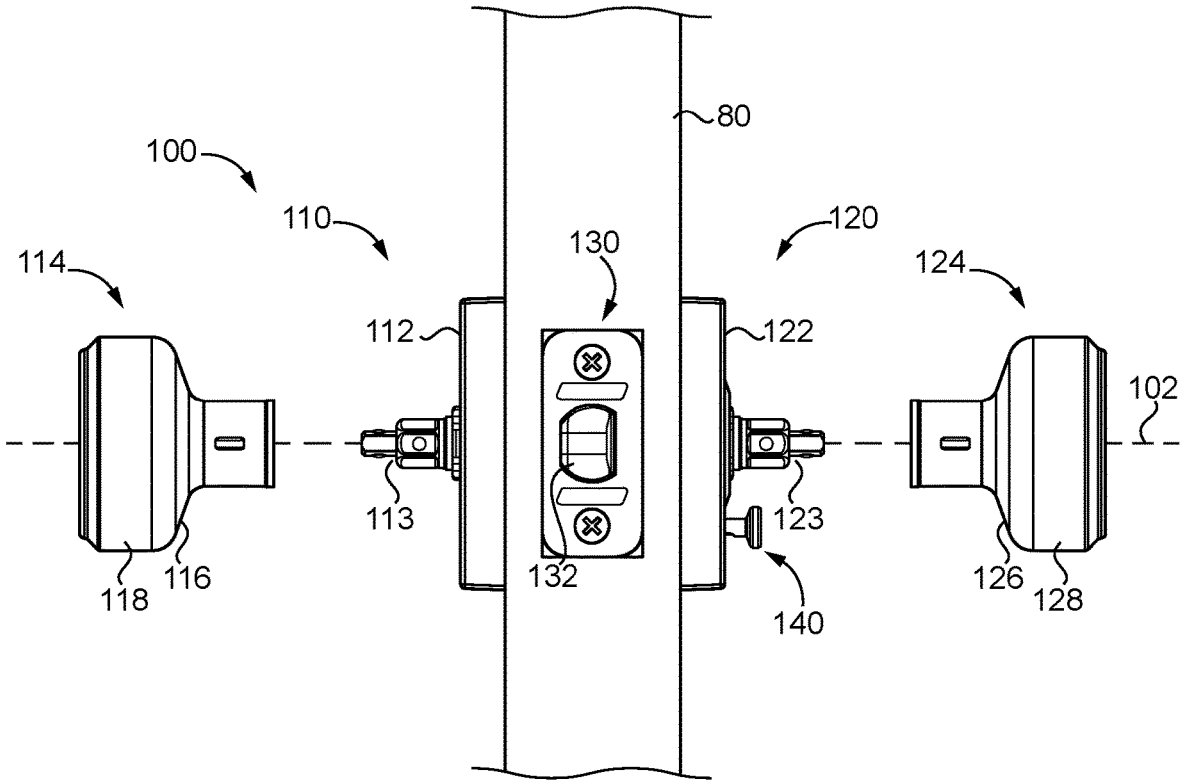
FIG. 1 is a partially-exploded assembly view of a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a lockset 100 according to certain embodiments mounted to a door 80. The lockset 100 generally includes an outside handleset 110 mounted to the outer side of the door 80, an inside handleset 120 mounted to the inner side of the door 80, and a latch mechanism 130 including a latchbolt 132 operable to project beyond a swinging edge of the door 80. As described herein, the latch mechanism 130 is operably coupled with the outside handleset 110 and the inside handleset 120 such that each handleset 110, 120 is at least selectively operable to retract the latchbolt 132. In certain forms, the lockset 100 may further include a locking mechanism 140 operable to selectively prevent retraction of the latchbolt 132 by the outside handleset 110.

The outside handleset 110 generally includes an outside housing 112 mounted to the door 80, an outside spindle 113 rotatably mounted to the housing 112 and extending along a longitudinal axis 102 of the lockset 100, and an outside knob assembly 114 mounted to the spindle 113. The knob assembly 114 generally includes a knob 116 rotationally coupled with the spindle 113 and a ring 118 rotatably mounted to the knob 116. An exemplary form of the knob assembly 114 is described below with reference to FIGS. 2-4.

The inside handleset 120 is substantially similar to the outside handleset 110, and generally includes an inside housing 122 mounted to the door 80, an inside spindle 123 rotatably mounted to the housing 122 and extending along a longitudinal axis 102 of the lockset 100, and an inside knob assembly 124 mounted to the spindle 123. The knob assembly 124 generally includes a knob 126 rotationally coupled with the spindle 123 and a ring 128 rotatably mounted to the knob 126. Exemplary forms of the knob assembly 124 are described below with reference to FIGS. 2-5.

The latch mechanism 130 includes the latchbolt 132, which has an extended position in which the latchbolt 132 is operable to retain the door 80 in a closed position relative to a doorframe and a retracted position in which the door 80 is free to move from the closed position to an open position. The latch mechanism 130 is operably connected with each spindle 113, 123 such that rotation of either spindle 113, 123 causes the latchbolt 132 to move from its extended position to its retracted position. The manner in which the spindles 113, 123 are operably coupled with the latch mechanism 130 to effect retraction of the latchbolt 132 is known in the art, and need not be described in further detail herein.

In embodiments that include the locking mechanism 140, the locking mechanism 140 is operable to selectively prevent the outside handleset 110 from retracting the latchbolt 132. The locking mechanism 140 may include a button movable between a projected position and a depressed position to transition the locking mechanism between a locking state in which the locking mechanism 140 prevents retraction of the latchbolt 132 by the outside handleset 110 and an unlocking state in which the locking mechanism 140 permits retraction of the latchbolt 132 by the outside handleset 110. Such selective locking of the outside handleset 110 is also known in the art, and need not be described in further detail herein.

As should be evident from the foregoing, rotation of the inside knob 126 causes a corresponding rotation of the inside spindle 123, thereby actuating the latch mechanism 130 to retract the latchbolt 132. When the locking mechanism 140 is in the unlocking state or is omitted, rotation of the outside knob 116 similarly causes a corresponding rotation of the outside spindle 113, thereby actuating the latch mechanism 130 to retract the latchbolt 132.

In conventional locksets, rotation of a knob such as either knob 116, 126 simply involves lightly gripping the radially outer surface of the knob and turning the knob to retract the latchbolt. In the illustrated form, however, such light gripping and rotation of the radially outer surface of either knob assembly 114, 124 does not cause rotation of the corresponding knob 116/126. Instead, such light gripping and rotation causes the ring 118/128 to rotate relative to the knob 116/126, thereby preventing rotation of the corresponding spindle 113/123 and actuation of the latch mechanism 130.

Figure 2:
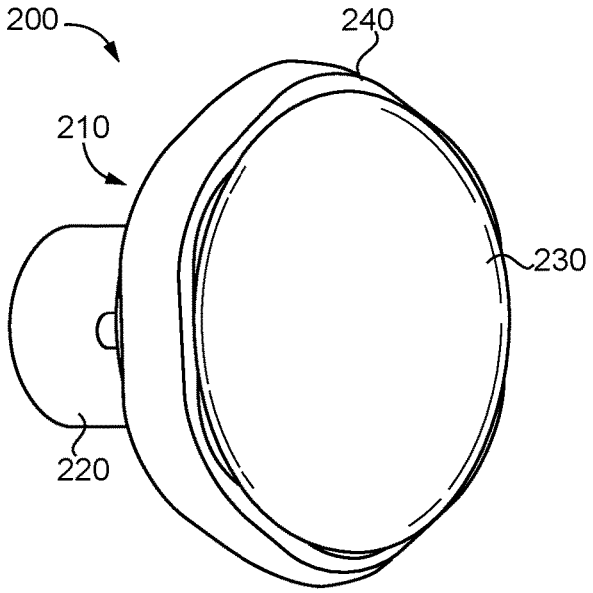
FIG. 2 is a perspective illustration of a knob assembly according to certain embodiments.

With additional reference to FIG. 2, illustrated therein is a knob assembly 200 according to certain embodiments. The knob assembly 200 generally includes a knob 210 having a shank 220 and a body portion 230, and a ring 240 rotatably mounted to the body portion 220, and may further include a coupling member 208 operable to selectively rotationally couple the ring 240 with the knob 210. The knob assembly 200 may, for example, be utilized as the knob assembly 114 of the outside handleset 110 and/or the knob assembly 124 of the inside handleset 120 in the lockset 100 illustrated in FIG. 1. It is also contemplated that the knob assembly 200 may be configured for use with a handleset such as the handlesets 110, 120 while being sold separately from the handleset and/or the lockset 100. While certain descriptions hereinafter are made with reference to the knob assembly 200 being provided as the inside knob assembly 124, it is to be appreciated that the knob assembly 200 may additionally or alternatively be provided as the outside knob assembly 114 or the knob assembly of a device other than a lockset 100.

Figure 4:
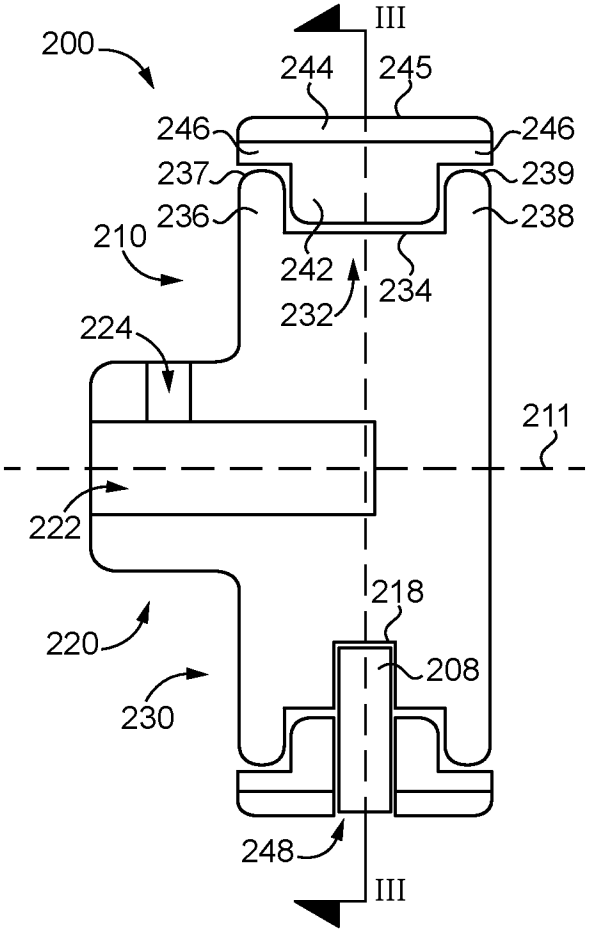
FIG. 4 is a cross-sectional illustration of the knob assembly illustrated in FIG. 2, with the cross-section taken along the line IV-IV illustrated in FIG. 3.
Figure 3:
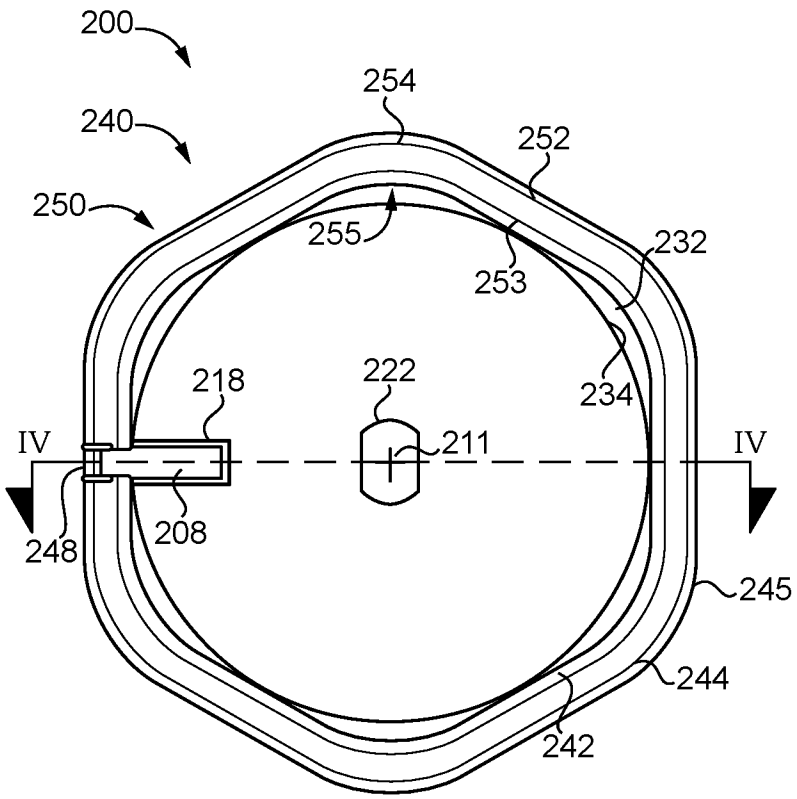
FIG. 3 is a cross-sectional illustration of the knob assembly illustrated in FIG. 2, with the cross-section taken along the line illustrated in FIG. 4.

With additional reference to FIGS. 3 and 4, the shank 220 extends along a longitudinal rotational axis 211 of the knob 210, and includes an opening 222 sized and shaped to receive the spindle 123, and a radial aperture 224 connected with the opening 222. The radial aperture 224 is operable to receive a coupler such as a set screw or a catch that aids in coupling the shank 220 to the spindle 123.

The body portion 230 extends radially outward from the shank 220, and has a circumferential channel 232 formed in the radially outer surface thereof. The circumferential channel 232 includes a base 234, a rear wall 236 defining a rear rim 237, and a front wall 238 longitudinally spaced from the rear wall 236 and defining a front rim 239. As described herein, the body portion 230 may further include an opening 218 operable to receive at least a portion of the coupling member 208, for example in embodiments in which the coupling member 208 is included. A front end of the body portion 230 defines a front face of the knob 210.

The ring 240 is seated in the circumferential channel 232, and includes a radially-inward portion 242 received in the channel 232 and a radially-outward portion 244 projecting out of the circumferential channel 232. The radially-outward portion 244 may define a pair of lips 246 that radially overlap the rims 237, 239 to aid in ensuring that a person attempting to grasp the knob 210 instead grasps the ring 240. The ring 240 is resilient such that the ring is self-biased toward a natural state and is elastically deformable to a deformed state. As described herein, the ring 240 is rotatable relative to the knob 210 when in the natural state, and is operable to transmit torque to the knob 210 when in the deformed state. In the illustrated form, the ring 240 does not axially cover the front face of the knob 210, which may aid in preserving the desired aesthetic of the knob assembly 200. It is also contemplated that the ring 240 may at least partially cover the front face of the knob 210.

In certain forms, the ring 240 may be formed of diverse materials. For example, the radially-inward portion 242 and the lips 246 may be formed of a first material, and the radially-outer surface 245 of the ring 240 may be formed of a second material. The first material and the second material may have different coefficients of friction. In the illustrated form, the radially-outer surface 245 has a higher coefficient of friction to facilitate grasping of the ring 240, and the radially-inward portion 242 and the lips 246 has a lower coefficient of friction to facilitate rotation of the ring 240 relative to the knob 210. It is also contemplated that the ring 240 may be formed of a single material, and/or may include coatings to provide the relatively higher and/or the relatively lower coefficients of friction.

In certain embodiments, the ring 240 may be formed of one or more compliant materials such that the ring 240 is operable to stretch over one of the rims 237, 239 for installation of the ring 240 to the knob 210. In other embodiments, the ring 240 may not necessarily be operable to stretch over the rims 237, 239. For example, the knob 210 may be formed of multiple pieces that, when coupled to one another, capture the ring 240 within the channel 232.

As illustrated in FIG. 3, the ring 240 has a polygonal shape 250, which in the illustrated form is provided as a generally hexagonal shape. The polygonal shape 250 includes sides 252 that are connected by vertices 254, and in the illustrated form the vertices 254 are rounded. The sides 252 engage the base 234 of the channel 232 and define contact areas 253. By contrast, the vertices 254 do not contact the base 234 of the channel 232, thereby defining non-contact areas 255. Thus, the illustrated interface between the knob 210 and the ring 240 is characterized by a plurality of contact areas 253 spaced apart from one another by a plurality of non-contact areas 255. This reduces the total area of contact between the knob 210 and the ring 240, thereby increasing the gripping force required to rotationally couple the knob 210 and the ring 240.

In the illustrated form, the contact areas 253 and non-contact areas 255 are provided by defining the circumferential channel 232 as an annular channel having a circular longitudinal cross-section (FIG. 3), and providing the ring 240 with a polygonal cross-section such that the sides 252 of the ring 240 contact the base 234 of the channel 232. It is also contemplated that these configurations may be reversed. For example, the circumferential channel 232 may have a polygonal cross-section while the ring 240 is provided in an annular form, such that the annular ring contacts the vertices of the polygonal base wall. In further embodiments, both the ring 240 and the circumferential channel 232 may be annular. In such forms, the ring 240 may be in contact with the base 234 throughout the circumferential interface. It is also contemplated that the ring 240 may have pads formed on the radially inner surface thereof to define the contact surfaces, and that non-contact surfaces may be defined as gaps between the contact pads.

During operation of the knob assembly 200, a user intending to rotate the knob 210 attempts to grasp the knob 210. With the ring 240 circumferentially surrounding the radially-outer surface of the knob 210, the user instead grasps the ring 240. When the user applies a light gripping force and rotates the ring 240, the ring 240 rotates freely relative to the knob 210, thereby preventing the user from rotating the knob 210. In order to rotate the knob 210, the user must instead apply to the ring 240 a gripping force sufficient to deform the ring 240 from its natural state to a deformed state to thereby cause the contact surfaces 253 of the ring 240 to frictionally engage the body portion 230. When such a gripping force is applied, the ring 240 frictionally rotationally couples with the body portion 230, thereby enabling the user to rotate the knob 210 by rotating the ring 240.

As will be appreciated, the amount of torque that can be transmitted via the frictional interface between the knob 210 and the ring 240 depends upon a number of factors, including the area of the frictional engagement, the coefficient of static friction at the frictional engagement, and the force urging the ring 240 into contact with the knob 210. Thus, the gripping force required to enable the ring 240 to transmit a given amount of torque likewise depends upon a number of factors. One such factor is the total area of contact between the ring 240 and the knob 210. For example, reducing the area of contact may increase the gripping force required, and increasing the area of contact may decrease the required gripping force. Another such factor is the coefficient of friction at the interface between the ring 240 and the knob 210. For example, greater coefficients of friction may reduce the gripping force required, whereas lower coefficients of friction may increase the gripping force required. A further factor is the stiffness of the ring 240, with a greater stiffness generally dictating a greater gripping force. Thus, by appropriate selection of these factors among others, the gripping force required to rotationally couple the knob 210 and the ring 240 can be provided at an appropriate or desired value.

Those skilled in the art will readily appreciate that the gripping force required to rotate the knob 210 may further depend upon factors determined outside the knob assembly 200 itself. For example, when used with the lockset 100, the gripping force required to transmit the torque necessary to rotate the spindle 123 depends in part upon the biasing force urging the spindle 123 toward its home or unrotated position. Thus, the required gripping force may be increased by increasing the spring torque biasing the spindle 123 toward its home position. Those familiar with handlesets will appreciate that handlesets are typically provided with a relatively stronger return spring when the handleset includes a lever, and are typically provided with a relatively weaker return spring when the handleset includes a knob. In certain forms, a handleset may include the knob assembly 200 and the return spring typically utilized in connection with levers, thereby further increasing the gripping force required to rotate the knob 210 when the knob 210 is mounted to the spindle 123.

It should be evident from the foregoing that the knob assembly 200 is operable to provide a free-spinning functionality whereby the ring 240 normally rotates relative to the knob 210, and frictionally engages the knob 210 for transmission of torque when a sufficient gripping force is applied to the ring. In certain forms, the knob assembly 200 may include a coupling member 208 operable to selectively couple the knob 210 and the ring 240 for joint rotation. In the illustrated form, the coupling member 208 is provided in the form of a pin 208 operable to selectively couple the knob 210 and the ring 240. The knob 210 includes an opening 218 and the ring 240 includes an aperture 248 operable to align with the opening 218. When so aligned, the pin 208 can be inserted into the opening 218 via the aperture 248 to rotationally couple the knob 210 and the ring 240, thereby disabling the free-spinning functionality of the knob assembly 200. Thus, the coupling member 208 has an inserted or coupling position in which the coupling member 208 extends between the aperture 248 and the opening 218 to thereby rotationally couple the ring 240 and the knob 210, and has a removed or decoupling position in which the coupling member 208 does not extend between the aperture 248 and the opening 218 to thereby rotationally decouple the ring 240 and the knob 210.

Although the knob assembly 200 has been described herein as being configured for use with a lockset 100, it is to be appreciated that the knob assembly 200 may be utilized in connection with devices other than locksets. For example, the knob assembly 200 may be utilized in connection with a faucet, a stove, or any other item that it is desired to discourage or prevent children from operating. Those skilled in the art will readily appreciate that in such forms, the opening 222 in the shank 220 may be configured for rotational coupling with a structure analogous to the spindle (e.g., a structure that, when rotated, adjusts the operating characteristics of the item to which it is coupled).

Figure 6:
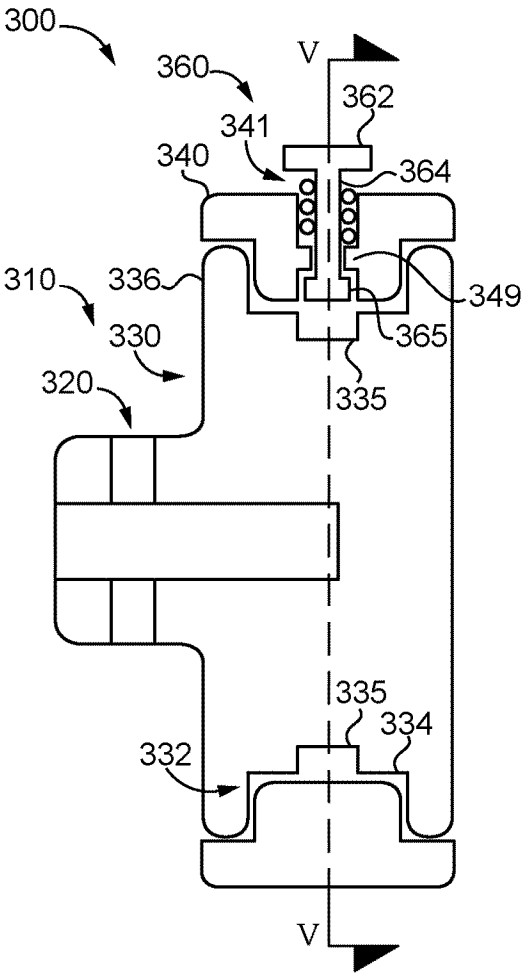
FIG. 6 is a cross-sectional illustration of the knob assembly illustrated in FIG. 5, with the cross-section taken along the line VI-VI illustrated in FIG. 5.
Figure 5:
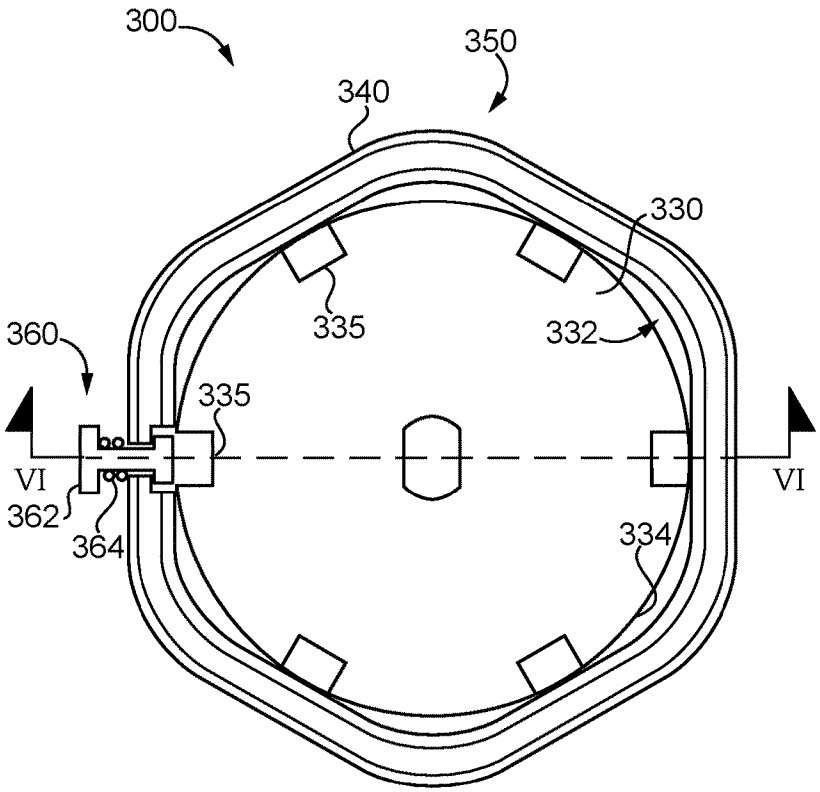
FIG. 5 is a cross-sectional illustration of a knob assembly according to certain embodiments, with the cross-section taken along the line V-V illustrated in FIG. 6.

With additional reference to FIGS. 5 and 6, illustrated therein is a knob assembly 300, which is another embodiment of the knob assembly 124. The knob assembly 300 is substantially similar to the above-described knob assembly 200, and similar reference characters are used to indicate similar elements and features. For example, the knob assembly 300 includes a knob 310 having a shank 320 and a body 330, and a ring 340 having a polygonal shape 350, which respectively correspond to the knob 210, shank 220, body portion 230, ring 240, and polygonal shape 250 of the above-described knob assembly 200. In the interest of conciseness, the following description of the knob assembly 300 focuses primarily on elements and features that are different from those described above with reference to the knob assembly 200. It is to be appreciated however, that elements and features described in association with the above-described knob assembly 200 may nonetheless be present in the knob assembly 300.

The knob assembly 300 further includes a detent mechanism 360 that is mounted to the ring 340 and operable to selectively couple the ring 340 with the knob 310. The detent mechanism 360 generally includes a pin 362 mounted within an opening 341 in the ring 340 for movement between a projected position and a depressed position, and a spring 364 biasing the pin 362 toward the projected position. The pin 362 may have an enlarged end portion 365 that cooperates with a neck 349 of the opening 341 to prevent radially-outward movement of the pin 362 beyond its projected position. Formed in the base 334 of the circumferential channel 332 are a plurality of angularly-spaced pockets 335, each of which is operable to receive the end portion 365 when the pin 362 is in the depressed position.

During operation of the knob assembly 300, the ring 340 is normally free to rotate relative to the knob 310 in a manner similar to that described above with reference to the ring 240 and the knob 210. Thus, a user attempting to rotate the knob 310 by rotating the ring 340 will be unable to do so. In order to rotate the knob 310, the user may depress the pin 362 to cause the enlarged end 365 of the pin 362 to enter one of the pockets 335, thereby rotationally coupling the ring 340 and the knob 310. With the knob 310 and ring 340 rotationally coupled by the detent mechanism 360, rotation of the ring 340 will serve to rotate the knob 310.

As should be evident from the foregoing, the knob assembly 300 may require that the user depress the pin 362 in order to rotationally couple the ring 340 with the knob 310 in order for the user's rotation of the ring 340 to be transmitted to the knob 310. For example, the ring 340 may be relatively rigid such that the ring 340 is not operable to deform in the manner described above with reference to the ring 240, and the coupling of the ring 340 and the knob 310 may require that the detent mechanism 360 be depressed. In addition to requiring a certain amount of dexterity, the detent mechanism 360 may require a certain degree of strength to operate, thereby providing a further hindrance against the knob assembly 300 being operated by children. For example, the spring 364 may be selected as a relatively heavy spring that is difficult to compress, thereby providing a significant biasing force that must be overcome in order to depress the pin 362.

Those skilled in the art will readily appreciate that the relative geometries of the pin 362 and the opening 341 may also be selected to provide a degree of resistance to movement of the pin 362 from the projected position to the depressed position. For example, the inner diameter of the neck 349 may closely correspond to the outer diameter of the narrow section of the pin 362 such that the neck 349 frictionally engages the pin 362, thereby further resisting depression of the pin 362. As will be appreciated, the strength of the spring 364 should be selected such that the spring 364 is capable of overcoming the frictional resistance to return the pin 362 to the projected position when the user releases the detent mechanism 360.

In the illustrated form, the detent mechanism 360 is mounted to the ring 340, and the pockets 335 are formed in the knob 310. It is also contemplated that this arrangement may be reversed, such that the detent mechanism 360 is mounted to the knob 310 and the pockets 335 are formed in the ring 340. For example, the detent mechanism 360 may be mounted to the rear wall 336 to discourage manipulation of the pin 362 by children. Furthermore, while a single detent mechanism 360 is illustrated, it is to be appreciated that the knob assembly 300 may include plural detent mechanisms 360. Additionally, while the illustrated knob assembly 300 includes a plurality of angularly-spaced pockets 335, it is also contemplated that the knob assembly 300 may include a single pocket. In such forms, the user may need to bring the ring 340 to a predetermined orientation (i.e., the orientation in which the detent mechanism 360 is aligned with the single pocket 335) prior to depressing the pin 362.

As noted above, it is to be appreciated that elements and features described in association with the above-described knob assembly 200 may be present in the knob assembly 300, despite the fact that such elements and features have not been specifically described and/or illustrated in connection with the knob assembly 300. For example, while a coupling mechanism is not specifically described and illustrated with respect to the knob assembly 300, it is to be appreciated that the knob assembly 300 may nonetheless include a coupling mechanism such as the above-described coupling mechanism 208. In certain forms, the detent mechanism 360 may serve as the coupling mechanism. For example, the pin 362 and the pockets 335 may include mating features that selectively retain the pin 362 in the depressed position, thereby rotationally coupling the knob 310 and the ring 340 even when the pin 362 is not being manually depressed by a user.

Figure 7:
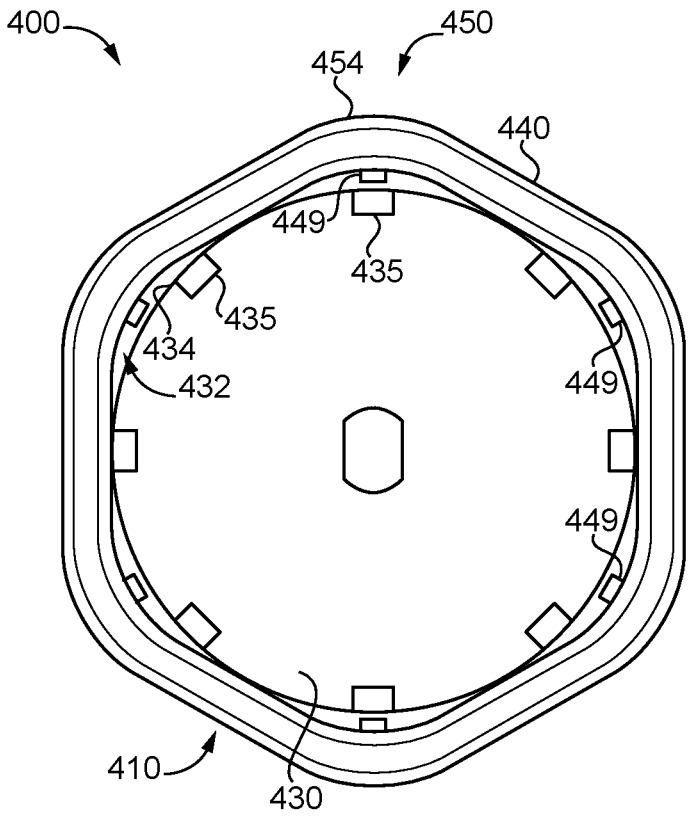
FIG. 7 is a cross-sectional illustration of a knob assembly according to certain embodiments.

With reference to FIG. 7, illustrated therein is another embodiment of a knob assembly 400. The knob assembly 400 is substantially similar to the above-described knob assembly 200, and similar reference characters are used to indicate similar elements and features. For example, the knob assembly 400 includes a knob 410 having a shank and a graspable portion 430, and a ring 440 having a polygonal shape 450, which respectively correspond to the knob 210, shank 220, graspable portion 230, ring 240, and polygonal shape 250 of the knob assembly 200. Those skilled in the art will readily appreciate that the cross-section of FIG. 7 is taken along a line analogous to the line illustrated in FIG. 4 or the line V-V illustrated in FIG. 6.

In the interest of conciseness, the following description of the knob assembly 400 focuses primarily on elements and features that are different from those described above with reference to the knob assembly 200. It is to be appreciated however, that elements and features described in association with the above-described knob assembly 200 may nonetheless be present in the knob assembly 400. For example, while a coupling member similar to the coupling member 208 is not specifically illustrated in connection with the knob assembly 400, it is to be appreciated that the knob assembly 400 may nonetheless include such a coupling member.

In the knob assembly 400, the ring 440 includes a plurality of radially-inward projections 449 that, in the illustrated form, are formed at the vertices 454 of the polygonal shape 450. Formed in the base 434 of the channel 432 are a plurality of pockets 435, each of which is sized and shaped to receive any of the projections 449. When the ring 440 is in its natural or undeformed state, the projections 449 are not received in the pockets 435, and the ring 440 is rotatable relative to the knob 410. When a user grasps the ring 440 and deforms one or more of the vertices 454 inward, the corresponding projection 449 is capable of entering a pocket 435 to rotationally couple the ring 440 with the knob 410, thereby permitting the user to rotate the knob 410 by rotating the ring 440.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A knob assembly, comprising:

a knob including a shank extending along a longitudinal axis and a body portion extending radially outward from the shank, the body portion comprising a circumferential channel; and a ring seated in the circumferential channel, the ring having a radially-inward portion received within the circumferential channel and a radially-outward portion projecting out of the circumferential channel, wherein the ring is resilient and has a natural state and a deformed state;

wherein with the ring in the natural state, the ring is free to rotate relative to the body portion;

wherein with the ring in the deformed state, the ring frictionally engages the body portion, thereby enabling transmission of torque between the ring and the knob; and wherein the ring is configured to transition from the natural state to the deformed state when gripped with a sufficient radially-inward gripping force.

2. The knob assembly of claim 1, wherein the ring has a plurality of contact areas that contact the body portion, and wherein the plurality of contact areas are spaced from one another by a plurality of non-contact areas that do not contact the body portion.

3. The knob assembly of claim 2, wherein the ring has a polygonal shape including sides and vertices;

wherein the contact areas are defined at the sides; and wherein the non-contact areas are defined at the vertices.

4. The knob assembly of claim 3, wherein the vertices are rounded.

5. The knob assembly of claim 2, wherein a radially outer surface of the ring has a first coefficient of friction, and wherein the contact areas have a second coefficient of friction less than the first coefficient of friction.

6. The knob assembly of claim 1, wherein the radially-outward portion of the ring is formed of a first material;

wherein the radially-inward portion of the ring contacts the knob and is formed of a second material; and wherein the first material has a higher coefficient of friction than the second material.

7. The knob assembly of claim 1, wherein the circumferential channel has a front wall and a rear wall, and wherein the front wall and the rear wall constrain longitudinal movement of the ring.

8. The knob assembly of claim 7, wherein the front wall defines a front rim;

wherein the rear wall defines a rear rim; and wherein the ring includes a front lip circumferentially surrounding the front rim and a rear lip circumferentially surrounding the rear rim.

9. The knob assembly of claim 1, further comprising a coupler operable to selectively rotationally couple the ring and the body portion.

10. A lockset including the knob assembly of claim 1, the lockset further comprising:

a latch mechanism comprising a bolt having an extended position and a retracted position; and a spindle operably connected with the latch mechanism such that rotation of the spindle drives the bolt from the extended position to the retracted position; and wherein the shank is rotationally coupled with the spindle.

11. A knob assembly, comprising:

a knob including a shank extending along a longitudinal axis and a body portion extending radially outward from the shank, wherein a radially outer surface of the body portion has a circumferential channel formed therein; and a ring seated in the circumferential channel, wherein the ring is deformable and is normally rotatable relative to the knob when in a first state, and is configured to engage and rotationally couple with the knob when compressed and deformed to a second state by a manually-applied gripping force.

12. A knob assembly, comprising:

a knob including a shank extending along a longitudinal axis and a body portion extending radially outward from the shank, wherein a radially outer surface of the body portion has a circumferential channel formed therein; and a ring seated in the circumferential channel, wherein the ring has a polygonal shape is normally rotatable relative to the knob, and is configured to engage and rotationally couple with the knob when compressed by a manually-applied gripping force.

13. The knob assembly of claim 11, wherein an inner surface of the ring comprises a radially-inward projection, wherein the base of the channel comprises a pocket operable to receive the radially-inward projection when the knob is compressed by the manually-applied gripping force to rotationally couple the ring with the knob.

14. The knob assembly of claim 13, wherein the ring has a polygonal shape, and wherein the projection is formed at a vertex of the polygonal shape.

15. The knob assembly of claim 11, wherein the circumferential channel is defined in part by a wall defining a rim; and wherein the ring includes a lip circumferentially surrounding the rim.

16. The knob assembly of claim 11, further comprising a coupler operable to selectively rotationally couple the ring and the knob.

17. A knob assembly, comprising:

a knob including a shank extending along a longitudinal axis and a body portion extending radially outward from the shank, wherein a radially outer surface of the body portion has a circumferential channel formed therein;

a ring seated in the circumferential channel, wherein the ring is normally rotatable relative to the knob, and is configured to engage and rotationally couple with the knob when compressed by a manually-applied gripping force; and a coupler operable to selectively rotationally couple the ring and the knob;

wherein the ring includes an aperture, and wherein the body portion of the knob includes an opening;

wherein the coupler has a coupling position in which the coupler extends between the aperture and the opening, thereby rotationally coupling the ring and the knob; and wherein the coupler has a decoupling position in which the coupler does not extend between the aperture and the opening, thereby rotationally decoupling the ring and the knob.

18. A handleset comprising the knob assembly of claim 11, further comprising a housing configured for mounting to a door and a spindle rotatably mounted to the housing, wherein the knob is rotationally coupled with the spindle, and wherein the spindle is biased toward a home position.

19. A lockset comprising the handleset of claim 18, further comprising a latch mechanism comprising a bolt having an extended position and a retracted position, wherein the spindle is operably connected with the latch mechanism such that rotation of the spindle drives the bolt from the extended position to the retracted position.

20. A knob assembly, comprising:

a knob including a shank extending along a longitudinal axis and a body portion extending radially outward from the shank and defining an opening, wherein a radially outer surface of the body portion has a circumferential channel formed therein;

a ring seated in the circumferential channel and defining an aperture, wherein the ring is normally rotatable relative to the knob; and a coupler having a first position in which the coupler does not extend between the aperture and the opening such that the ring is rotationally decoupled from the knob, and a second position in which the coupler extends between the aperture and the opening such that the coupler rotationally couples the knob and the ring.

21. The knob assembly of claim 20, wherein the coupler comprises a detent mechanism;

wherein the detent mechanism is mounted to one of the ring or the knob; and wherein the other of the ring or the knob includes a plurality of angularly-spaced pockets operable to receive an end portion of the detent mechanism when the detent mechanism is in the second position.

22. The knob assembly of claim 20, wherein the coupler is biased toward the first position and is manually movable to the second position.

23. The knob assembly of claim 12, wherein sides of the polygonal shape ring contact a base of the circumferential channel and vertices of the polygonal shape ring do not contact the base of the circumferential channel.

24. The knob assembly of claim 20, wherein the coupler has a coupling position in which the coupler extends between the aperture and the opening, thereby rotationally coupling the ring and the knob; and wherein the coupler has a decoupling position in which the coupler does not extend between the aperture and the opening, thereby rotationally decoupling the ring and the knob.

* * * * *